US006872168B2

(12) United States Patent
Wang et al.

(10) Patent No.: US 6,872,168 B2
(45) Date of Patent: Mar. 29, 2005

(54) SHOCK ABSORPTION STRUCTURE FOR A TREADMILL

(76) Inventors: Leao Wang, No.1, Lane 233, Sec.2, Charng Long Rd., Taiping (TW), 411; Peter Wu, No.1, Lane 233, Sec.2, Charng Long Rd., Taiping (TW), 411

( * ) Notice: Subject to any disclaimer, the term of this patent is extended or adjusted under 35 U.S.C. 154(b) by 0 days.

(21) Appl. No.: 10/351,141

(22) Filed: Jan. 27, 2003

(65) Prior Publication Data

US 2004/0147371 A1 Jul. 29, 2004

(51) Int. Cl.[7] ..... A63B 22/02
(52) U.S. Cl. ..... 482/54
(58) Field of Search ..... 482/54, 51

(56) References Cited

U.S. PATENT DOCUMENTS 5,072,928 A * 12/1991 Stearns et al. ..... 482/54
5,336,146 A * 8/1994 Piaget et al. ..... 482/54
5,626,539 A * 5/1997 Piaget et al. ..... 482/54
6,461,279 B1 * 10/2002 Kuo ..... 482/54

* cited by examiner

*Primary Examiner*—Stephen R. Crow
(74) *Attorney, Agent, or Firm*—Troxell Law Office, PLLC; Kuo-Hsiung Chiu

(57) ABSTRACT

The present invention relates to a shock absorption structure for a treadmill having two handle frames, a support base, a frame portion and an adjustable supporting foot. A connecting arm has one end pivotably connected to the lower portion of each of both handle frames and the other end pivotably connected to the frame portion. A flexible shock absorption unit is pivotably interposed between an extension member of each handle frame and each connecting arm. Therefore, when the force is applied to the frame portion, both flexible shock absorption units provide proper cushioning effect. Moreover, the flexible shock absorption unit is constructed in such a way that the cushioning force can be freely adjustable so as to enhance the using comfort.

3 Claims, 3 Drawing Sheets

SHOCK ABSORPTION STRUCTURE FOR A TREADMILL

BACKGROUND OF THE INVENTION

1. Field of the Invention

The present invention relates to a new and improved design of a shock absorption structure for a treadmill, and more particularly, to a structure which utilizes two connecting arms and two flexible shock absorption units. Each of the flexible shock absorption units is pivotably interposed between an extension member of the handle frame and the connecting arm. Therefore, when the force is applied to the frame portion, both flexible shock absorption units provide proper cushioning effect. Moreover, the flexible shock absorption unit is constructed in such a way that the cushioning force can be freely adjustable so as to enhance the using comfort.

2. Description of the Prior Art

In general, the treadmill is provided with cushioning apparatuses at suitable places for achieving a proper cushioning effect and enhancing the comfort of the operator during a workout session. Meanwhile, a protection mechanism has been developed for preventing both feet of the operator from being injured due to the too large reactive force of the platform of the treadmill. It will be particularly beneficial to the operator if hydraulic or pneumatic cylinders are used to provide more excellent cushioning effect. A few prior arts such as U.S. Pat. Nos. 4,591,147, 5,184,988, 4,974,831, 4,984,810, 5,072,928, 5,372,559, etc. have disclosed the application of hydraulic or pneumatic cylinders to the treadmill.

Although the above-mentioned prior arts have advantages of more excellent protection effect and greater comfort, they all don't have any automatic mechanism for adjusting the cushioning force by operators themselves to meet their own different requirements. In brief, a operator with heavier weight would feel that the cushioning force is too slight while a operator with lighter weight could feel that it is too strong if the cushioning force is fixed at a certain extent. Besides, different operators are their own subjective feeling about the cushioning strength no matter how strong or light the cushioning force is. In addition, some operators have special rehabilitation requirements thereto. Accordingly, the prior arts are required for improvement.

SUMMARY OF THE INVENTION

It is a primary object of the present invention to remove the above-mentioned drawbacks and to provide a shock absorption structure for a treadmill that employs hydraulic or pneumatic cylinders as shock absorption source. The flexible shock absorption units can be adjustable. Meanwhile, the present invention utilizes two connecting arms and two flexible shock absorption units. Each of the flexible shock absorption units is pivotably interposed between an extension member of the handle frame and the connecting arm. Moreover, the connecting arms are pivotal for increasing the whole cushioning effect, thereby achieving the preset object of the present invention.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

First of all, it has to be noted that the present invention is a continuation of U.S. Pat. No. 6,050,921 "top weighted shock absorption structure".

Figure 1:
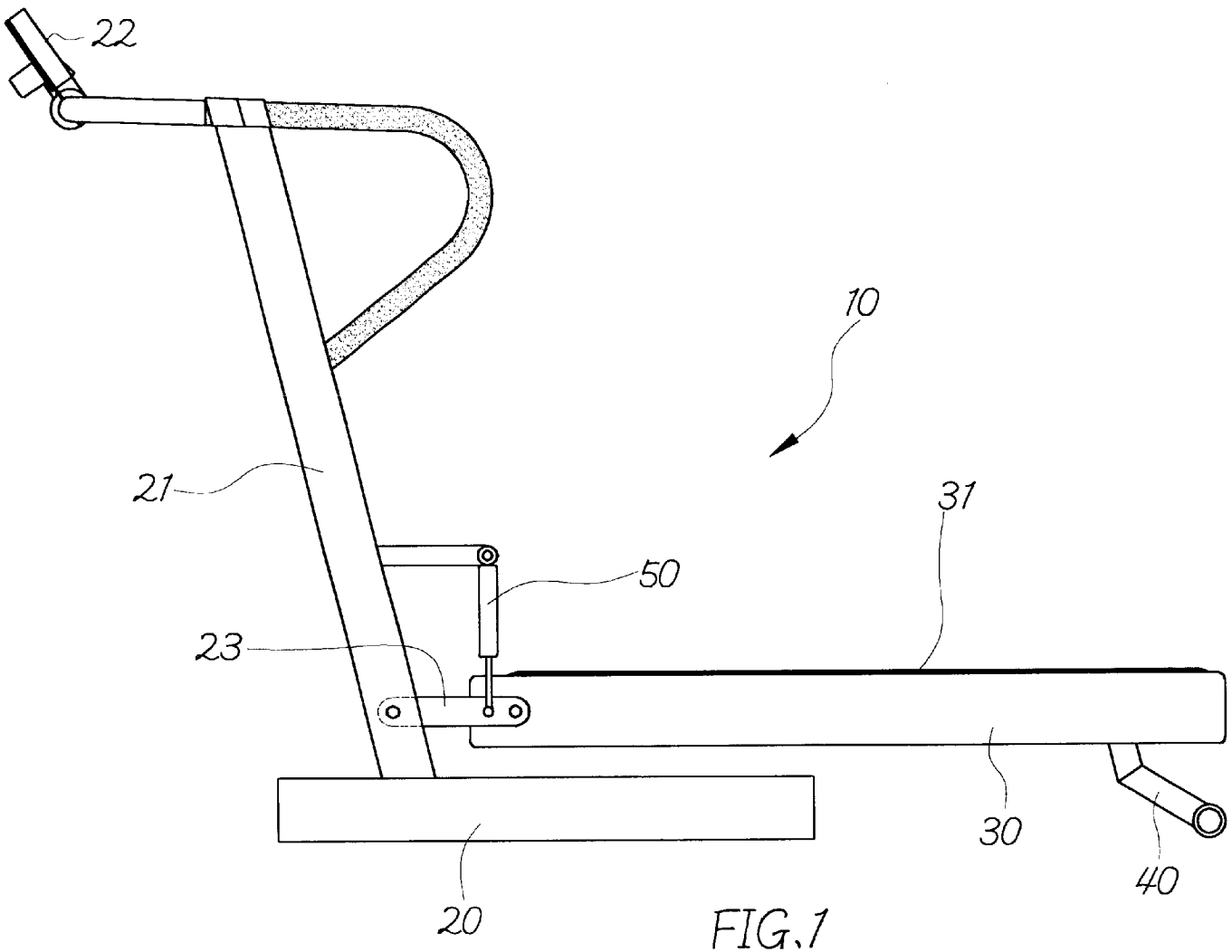
FIG. 1 is a side view of a preferred embodiment of the present invention.
Figure 2:
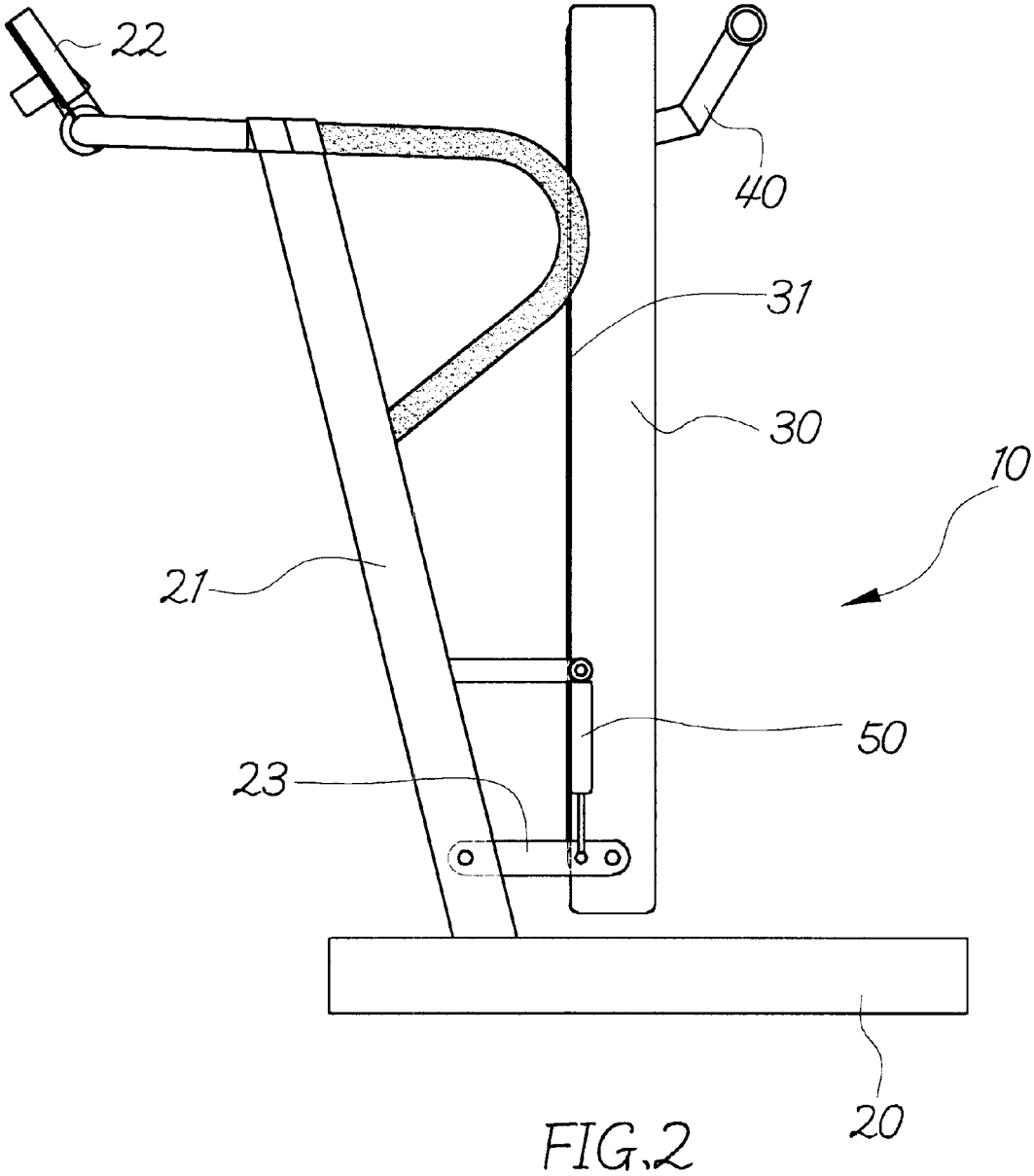
FIG. 2 is a side view of the preferred embodiment of present invention in folding-up position.

Referring to FIGS. 1 and 2, preferred embodiment of the present invention is shown. The treadmill 10 includes a support base 20 and a frame portion 30. A handle frame 21 is fixed at both sides of the support base 20 and extends upwardly therebetween. A console 22 is mounted on the handle frame 21. A running belt 31 extends around the frame portion 30 so that the operator can stand thereon to take the walking, jogging or running exercise. Moreover, an adjustable supporting foot 40 is installed under the frame portion 30 such that the frame portion 30 is adjustable in an uphill or downhill position.

A connecting arm 23 has one end pivotably connected to the lower portion of each of both handle frames 21 and the other end pivotably connected to the frame portion 30. A flexible shock absorption unit 50 is pivotably interposed between an extension member of each handle frame 21 and each connecting arm 23. Therefore, when the force is applied to the frame portion 30, both flexible shock absorption units 50 provide proper cushioning effect.

Moreover, the flexible shock absorption unit 50 is constructed in such a way that the cushioning force can be freely adjustable so as to enhance the using comfort.

As illustrated in FIG. 2, the arrangement of the connecting arms 23 and the flexible shock absorption units 50 won't influence the effect of the folding-up frame portion 30.

Figure 3:
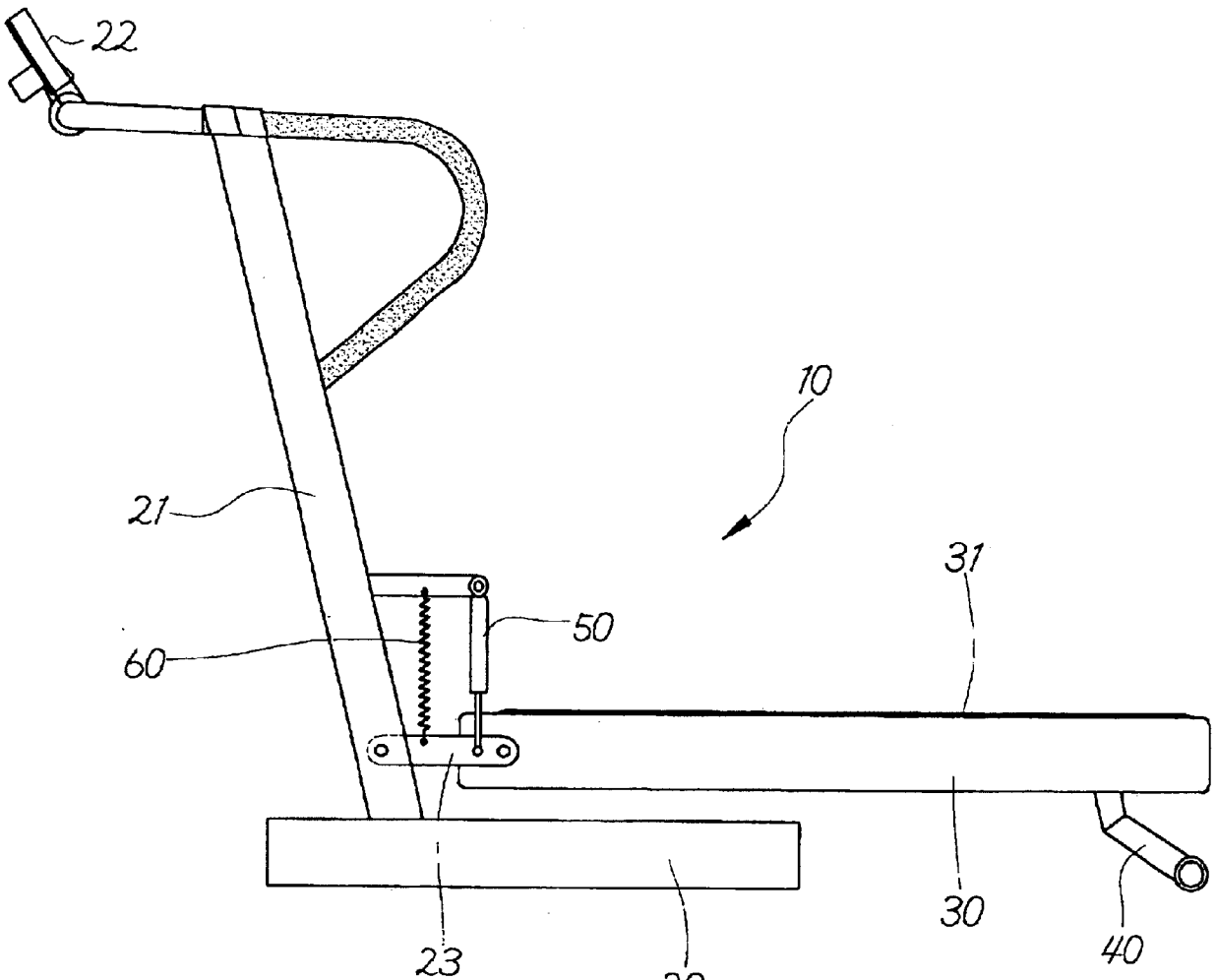
FIG. 3 is a side view of another preferred embodiment of the present invention.

Referring to FIG. 3, another embodiment of the present invention is shown. In order to lessen the loading of the flexible shock absorption units 50 and to increase the restoring force, a spring member 60 is disposed beside each of the flexible shock absorption units 50.

Many changes and modifications in the above-described embodiment of the invention can, of course, be carried out without departing from the scope thereof Accordingly, to promote the progress in science and the useful arts, the invention is disclosed and is intended to be limited only by the scope of the appended claims.

What is claimed is:

1. A shack absorbing structure for a treadmill comprising:

a) a support base;

b) two handle frames extending upwardly from and connected to opposing sides of the support base;

c) a frame portion having a running belt;

d) two connecting arms, each of the two connecting arms pivotally connected at a first end to one of the two handle frames and pivotally connected at a second end to opposing sides of the frame portion;

e) two flexible shock absorption units, each of the two flexible shock absorption units pivotally connected at a first end to one of the two handle frames and pivotally connected at a second end to an adjacent one of the two connecting arms; and f) an adjustable supporting foot connected to the frame portion at an end opposite the two connecting arms; wherein the frame portion is pivotal between open and closed positions.

2. The shock absorbing structure according to claim 1, further comprising two spring members, each of the two spring members connected between one of the two handle frames and an adjacent one of the two connecting arms.

3. The shock absorbing structure according to claim 1, wherein the adjustable supporting foot pivots the frame portion relative to the support frame and the two handle frames.

* * * * *